US006873978B1

(12) United States Patent
Boucher et al.

(10) Patent No.: US 6,873,978 B1
(45) Date of Patent: Mar. 29, 2005

(54) EVENT INTERFACE FOR A CARRIER MANAGER SYSTEM

(75) Inventors: Glenn Boucher, Shelton, CT (US); Terri A. Carroll, Milford, CT (US); Jacques E. Hasbani, Bethel, CT (US); Kenneth Karbowski, Farmington, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 08/942,261

(22) Filed: Oct. 1, 1997

(51) Int. Cl.[7] ..... G07B 17/00
(52) U.S. Cl. ..... 705/401; 705/402
(58) Field of Search ..... 705/400, 401, 705/402, 410

(56) References Cited

U.S. PATENT DOCUMENTS

| | | | | |
|---|---|---|---|---|
| 4,122,532 A | | 10/1978 | Dlugos et al. | 364/900 |
| 4,138,735 A | * | 2/1979 | Allocca et al. | 705/409 |
| 4,249,241 A | | 2/1981 | Aberle et al. | 364/200 |
| 4,320,461 A | * | 3/1982 | Dlugos | 705/410 |
| 4,528,644 A | | 7/1985 | Soderberg et al. | 364/900 |
| 4,736,687 A | | 4/1988 | Grube et al. | 104/88 |
| 4,901,237 A | * | 2/1990 | Hikita et al. | 705/414 |

(Continued)

FOREIGN PATENT DOCUMENTS

| | | | |
|---|---|---|---|
| EP | 304072 A2 | | 8/1988 |
| EP | 0336552 A2 | | 2/1989 |
| EP | 623876 A2 | | 3/1994 |
| EP | 0713177 A1 | | 11/1995 |
| EP | 0747811 A2 | | 5/1996 |
| EP | 0841615 A2 | | 9/1997 |
| GB | 2331601 A | * | 5/1999 |
| JP | 55-142216 | * | 10/1980 |
| JP | 59-34121 | * | 2/1984 |
| JP | 07-260881 | * | 10/1995 |
| JP | 010191232 A | | 7/1998 |
| WO | 91/02313 A1 | | 8/1989 |
| WO | 94/11817 A1 | | 11/1993 |
| WO | 95/01598 | | 1/1995 |
| WO | 96/08765 A1 | | 9/1995 |
| WO | 98/33106 | | 7/1998 |

OTHER PUBLICATIONS

Kostas: "ISDN overview": Telephone Engineer & Management; Dec. 1, 1984; v88, p. 153.*

Egan: "Costing and Pricing for an Integrated Digital Telecommunications Network": Nov. 1987; Telecommuncations v21 n11; pp. 47–54. (Abstract Only).*

"ZD Net Launched On Microsoft Network": Newsbytes News Network; Aug. 25, 1995.*

"Object–Oriented Modeling and Design", Learning Tree International, J. Rumbaugh, M. Glaha, W. Premerlani, F. Eddy, W. Lorensen.

Griss, Martin L. et al. "Building object–oriented instructment kits".

*Primary Examiner*—Edward R. Cosimano
(74) *Attorney, Agent, or Firm*—Brian A. Lemm; Angelo N. Chaclas

(57) ABSTRACT

A carrier management module in a carrier management system with a first application and a second application is configured to broker carrier rating requests from the second application to the first application through an event interface. The carrier, management module also loads carrier rate modules, programmed to rate items for carriers, so that both applications can call rating routines in the carrier rate modules to rate an item for the associated carrier. Specifically, the carrier management module accesses a system registry of supported carriers to determine whether to dispatch an event to the first application to rate an item for a carrier not supported by the carrier rate module.

17 Claims, 5 Drawing Sheets

U.S. PATENT DOCUMENTS

| | | | | | |
|---|---|---|---|---|---|
| 4,999,806 | A | | 3/1991 | Chernow et al. | 364/900 |
| 5,014,193 | A | | 5/1991 | Garner et al. | 364/200 |
| 5,040,132 | A | | 8/1991 | Schuricht et al. | 364/523 |
| 5,072,397 | A | | 12/1991 | Barns-Slavin et al. | 364/464.02 |
| 5,077,660 | A | | 12/1991 | Haines et al. | 705/410 |
| 5,107,455 | A | | 4/1992 | Haines et al. | 395/275 |
| 5,193,180 | A | | 3/1993 | Hastings | 395/575 |
| 5,247,683 | A | | 9/1993 | Holmes et al. | 395/700 |
| 5,261,080 | A | | 11/1993 | Khoyi et al. | 395/500 |
| 5,287,270 | A | | 2/1994 | Hardy et al. | 364/408 |
| 5,293,310 | A | | 3/1994 | Carroll et al. | 364/408 |
| 5,303,379 | A | | 4/1994 | Khoyi et al. | 395/700 |
| 5,325,290 | A | | 6/1994 | Cauffman et al. | 364/401 |
| 5,337,246 | A | | 8/1994 | Carroll et al. | 364/464.02 |
| 5,367,671 | A | | 11/1994 | Feigenbaum et al. | 395/600 |
| 5,369,401 | A | | 11/1994 | Haines | 340/825.35 |
| 5,369,778 | A | | 11/1994 | San Soucie et al. | 395/800 |
| 5,421,009 | A | | 5/1995 | Platt | 395/600 |
| 5,421,015 | A | | 5/1995 | Khoyi et al. | 718/107 |
| 5,444,630 | A | | 8/1995 | Dlugos | 364/464.02 |
| 5,446,896 | A | | 8/1995 | Hegarty et al. | 395/650 |
| 5,473,630 | A | | 12/1995 | Penzias et al. | 375/114 |
| 5,485,369 | A | | 1/1996 | Nicholls et al. | 364/401 |
| 5,515,425 | A | | 5/1996 | Penzias et al. | 379/114 |
| 5,546,577 | A | | 8/1996 | Marlin et al. | 395/600 |
| 5,548,756 | A | | 8/1996 | Tantry et al. | 395/600 |
| 5,550,976 | A | | 8/1996 | Henderson et al. | 395/200.06 |
| 5,555,416 | A | | 9/1996 | Owens et al. | 395/700 |
| 5,581,463 | A | * | 12/1996 | Constant et al. | 705/400 |
| 5,604,906 | A | | 2/1997 | Murphy et al. | 395/712 |
| 5,612,884 | A | | 3/1997 | Haines | 364/464.13 |
| 5,631,827 | A | | 5/1997 | Nicholls et al. | 395/228 |
| 5,666,493 | A | | 9/1997 | Wojcik | 705/26 |
| 5,666,501 | A | | 9/1997 | Jones et al. | 345/348 |
| 5,680,615 | A | | 10/1997 | Marlin et al. | 395/614 |
| 5,729,457 | A | | 3/1998 | Seymour | 364/449.9 |
| 5,748,980 | A | | 5/1998 | Lipe et al. | 395/828 |
| 5,752,027 | A | | 5/1998 | Familiar | 395/614 |
| 5,758,154 | A | | 5/1998 | Qureshi | 395/651 |
| 5,758,329 | A | | 5/1998 | Wojcik et al. | 395/209 |
| 5,764,977 | A | | 6/1998 | Oulid-Aissa et al. | 395/610 |
| 5,771,381 | A | | 6/1998 | Jones et al. | 395/653 |
| 5,778,348 | A | * | 7/1998 | Manduley et al. | 705/409 |
| 5,778,377 | A | | 7/1998 | Marlin et al. | 707/103 |
| 5,787,246 | A | | 7/1998 | Lichtman et al. | 395/200.5 |
| 5,809,329 | A | | 9/1998 | Lichtman et al. | 395/828 |
| 5,812,991 | A | * | 9/1998 | Kara | 705/410 |
| 5,832,218 | A | | 11/1998 | Gibbs et al. | 395/200.33 |
| 5,835,777 | A | | 11/1998 | Staelin | 395/712 |
| 5,845,090 | A | | 12/1998 | Collins, III et al. | 395/200.51 |
| 5,852,813 | A | | 12/1998 | Guenther et al. | 705/408 |
| 5,857,197 | A | | 1/1999 | Mullins | 707/103 |
| 5,860,012 | A | | 1/1999 | Luu | 395/712 |
| 5,881,236 | A | | 3/1999 | Dickey | 395/200.51 |
| 5,899,998 | A | | 5/1999 | McGauley et al. | 707/104 |
| 5,909,575 | A | | 6/1999 | Perry | 395/653 |
| 5,909,581 | A | | 6/1999 | Park | 395/712 |
| 5,933,647 | A | | 8/1999 | Aronberg et al. | 395/712 |
| 5,956,505 | A | * | 9/1999 | Manduley | 713/1 |
| 5,963,743 | A | | 10/1999 | Amberg et al. | 395/712 |
| 6,012,065 | A | * | 1/2000 | Boucher et al. | 707/103 |
| 6,018,725 | A | * | 1/2000 | Boucher et al. | 705/401 |
| 6,047,267 | A | | 4/2000 | Owens et al. | 705/34 |
| 6,078,889 | A | * | 6/2000 | Boucher et al. | 705/1 |
| 6,169,977 | B1 | * | 1/2001 | Hasbani et al. | 705/402 |
| 6,182,117 | B1 | | 1/2001 | Christie et al. | 709/205 |
| 6,301,707 | B1 | | 10/2001 | Carroll et al. | 717/11 |
| 6,425,016 | B1 | | 7/2002 | Banavar et al. | 709/310 |
| 2002/0065827 | A1 | | 5/2002 | Christie et al. | 709/10 |

* cited by examiner

EVENT INTERFACE FOR A CARRIER MANAGER SYSTEM

RELATED APPLICATIONS

Reference is made to application Ser. No. 08/942,265, now U.S. Pat. No. 6,301,707, entitled INSTALLING SOFTWARE BASED ON A PROFILE, assigned to the assignee of this application and filed on even date herewith.

Reference is made to application Ser. No. 08/942,209, now abandoned, entitled CARRIER MANAGER INTERFACE UTILIZING AN OCX CONTROL, assigned to the assignee of this application and filed on even date herewith.

Reference is made to application Ser. No. 08/942,263, now U.S. Pat. No. 6,012,065, entitled A METHOD AND SYSTEM FOR ACCESSING CARRIER DATA, assigned to the assignee of this application and filed on even date herewith.

Reference is made to now pending application Ser. No. 08/942,264, entitled A METHOD AND SYSTEM FOR CHANGING RATING DATA VIA INTERNET OR MODEM IN A CARRIER MANAGEMENT SYSTEM, assigned to the assignee of this application and filed on even date herewith.

Reference is made to application Ser. No. 08/942,262, now U.S. Pat. No. 6,078,889, entitled A METHOD AND SYSTEM OF IMPLEMENTING A CARRIER MANAGER LIBRARIAN, assigned to the assignee of this application and filed on even date herewith.

Reference is made to application Ser. No. 08/942,260, now U.S. Pat. No. 6,018,725 entitled A METHOD AND SYSTEM OF IMPLEMENTING A CARRIER MANAGER REGISTRY, assigned to the assignee of this application and filed on even date herewith.

FIELD OF THE INVENTION

The present invention relates to computerized logistics systems and, more particularly, to a system and method of rating items to be shipped by a carrier selected from among a plurality of carriers.

BACKGROUND OF THE INVENTION

Related, commonly assigned U.S. patent applications, listed hereinabove, describe a novel carrier management architecture for rating items to be shipped by a carrier. A shipping carrier is a company that provides shipping services for letters, packages, bulk goods, or any other item to be shipped. Carriers can perform a variety of shipping services. For example, they can deliver express shipments, e.g. airmail for letters and second-day air for small packages. Moreover, carriers can deliver ground shipments for packages, or "LTL" shipments for bulk goods. The term "LTL" means "Less Than Truckload" and applies to any ground carrier shipment of standard commodities, for example, rated in units of hundreds of pounds. Shipments of bulk goods or standard commodities usually occupy a portion of a truck trailer, hence "less than truckload," but may require an entire truckload, occasionally known as "TL" shipments.

Each carrier has its own rate structure for charging shippers for transporting their goods. Typically, these rates structures are complex and involve a variety of factors. For example, carriers often charge different prices by weight, sometimes with different weight classifications. As another example, carrier rates may depend on the distance to the destination. In addition, some carriers charge a premium for shipping classes, e.g. first class and second class, with shorter or longer guaranteed delivery times. In some cases, carriers may grant discounts for volume. Thus, the business rules for rating items to be transported varies greatly from carrier to carrier. These rating calculations may change over time for a particular carrier as its rates and business rules are updated. Accordingly, it is desirable to provide mechanisms for logistics systems for shipping goods to facilitate updating how carrier rates are calculated.

As described in the related applications and illustrated in FIG. 1, a logistics system 100 includes a first client application 110, which is configured to perform various shipping tasks. At least some of the functionality for rating items to be shipped by a carrier is performed by a run-time loadable carrier management module 102. Carrier management module 102 is configured to access entries in a system registry 104 for run-time loading one or more carrier rate modules 106. More specifically, the carrier rate modules 106 are loaded into the executable space of the first client application 110, thereby avoiding the use of resource intensive inter-process communication (IPC) mechanisms (e.g. named pipes, etc.)

Each carrier rate module 106 includes program instructions to accesses carrier rate data 108 and rate items using business rules encapsulated therein together with accessed carrier rate data 108 for an associated carrier. After loading a carrier rate module 106, the carrier manager module provides an entry point in the carrier rate module 106 to the first client application 110. In this manner, the first client application 110 can invoke the instructions in the carrier rate module 106 to rate item for the carrier associated with the carrier rate module 106.

The carrier management module 102, moreover, can also be loaded by a second client application 120 for utilizing the carrier rating functionality of the carrier rate modules 106 as described hereinabove in connection with the first client application 110. Thus, isolated carrier rate modules 106, managed by a carrier management module 102, are arranged to provide carrier rating functionality for a plurality of client applications 110 and 120.

In some implementations, the versions of the first client application 110 may have developed before the carrier manager architecture described herein was designed. For example, the first client application 110 may be a shipping application for rating letters and packages shipped by express carriers. When the carrier manager architecture was designed, it is relatively easy to upgrade the first client application to access the carrier management module 102 for the carrier rating functions in the new carrier rate modules 106. In the example, the new carrier rate modules may contain LTL rating routines for shipping items by truck. Thus, to add trucking functionality to the legacy shipping application, it is relatively straightforward to call the new carrier management module 102 to load the carrier rate modules 106 for LTL rating.

The first client application 110 still includes the prior carrier rating routines of its own for rating items based on carrier rate data 112 for carriers not supported by the carrier rate modules 106. In the example, the shipping application still contains routines for rating letters and packages on supported carriers. However, it is difficult to extract the carrier rating routines from the first client application 110 for creating a new carrier rate module 106. Legacy systems tend to break if large-scale modifications are made thereto such as replacing the carrier rating routines in favor of the carrier manager architecture.

Keeping the carrier rating routines in the first client application 110 instead of in the carrier rate modules 106 means that rating functionality for those carriers are not available to the second client application 120. In the example, the second client application 120 may be a load planning application. In the configuration depicted in FIG. 1, the load planning application (i.e. second client application 120) only has access to the LTL rating routines in carrier rate modules 106, not to the express or ground carrier rating routines embedded in the legacy shipping application 110. Thus, it is desirable to make that carrier rating functionality of the first application 110 available to the second application 120, without having to make large-scale modifications to the first application 110. The first client application 110, however, may be implemented in a programming language or environment in which it is very difficult or impossible to receive requests directly from the second client application 120 for rating items for the first carrier.

SUMMARY OF THE INVENTION

There exists a need for a carrier management system in one application which can use the carrier rating functionality of another application. There is also a need to provide the carrier rating functionality of one application to another, without having to make large-scale modifications thereto.

These and other needs are met by the present invention, in which a carrier management system includes a first application for rating items for a first carrier, a carrier management module loadable by the first application for loading a carrier rate module for rating items for a second carrier, and a second application configured to call the carrier management module. The carrier management module is configured to broker requests from the second application for rating items for a first carrier to the first application. Since the carrier management module is loadable by the first application, the carrier management is able to communicate easily without requiring large-scale modifications to the first application.

Accordingly, one aspect of the invention a carrier management system comprising a first application is configured to rate items for a first carrier. A carrier management module is configured to load one or more carrier rate modules for rating item for one or more supported carriers. A second application is configured to request the carrier management module to rate an item for a selected carrier. The carrier management module is configured, in response to the second application, to determine whether the selected carrier is supported by the one of the carrier rate module, and, if not, cause the first application to rate the item for the selected carrier, for example by dispatching an event to the first application and receiving back a rating result. If the selected carrier is indeed supported, then rating of the item by the one carrier rate module is enabled.

Another aspect of the invention is a method and a computer-readable medium bearing a carrier management module for coordinating a request to rate an item for a carrier supported by a first application. The method and software product includes the steps of receiving the request through a first interface, e.g. a function call interface, from a second application and dispatching the request through a second interface, e.g. an event interface, to the first application. A rating result is received from the first application and returned to the second application.

Still another aspect is a method and a computer-readable medium bearing a carrier management module for coordinating a request to rate an item for a carrier including the step of loading carrier rate modules into the executable space of an application. The request to rate the item for a carrier is received. If it is determined that one of the carrier rate modules is configured to rate the item for the carrier, then the carrier rate module is enabled for rating the item. On the other hand, if it is not determined that any of the carrier rate modules is configured to rate the item for the carrier, then an event indicative of the request is dispatched to the application, and a rating result indicative of rating the result for the carrier is received from the application.

The first application can be easily modified to respond to an additional event. Therefore, dispatching an event to the first application in response to a request by the second application enables the second application to have access to the carrier rating functionality of the first application without the need for large-scale modifications to the first application.

Additional objects, advantages, and novel features of the present invention will be set forth in part in the description that follows, and in part, will become apparent upon examination or may be learned by practice of the invention. The objects and advantages of the invention may be realized and obtained by means of the instrumentalities and combinations particularly pointed out in the appended claims.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENTS

A system and a method for rating items for carriers are described. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

Hardware Overview

Figure 1:
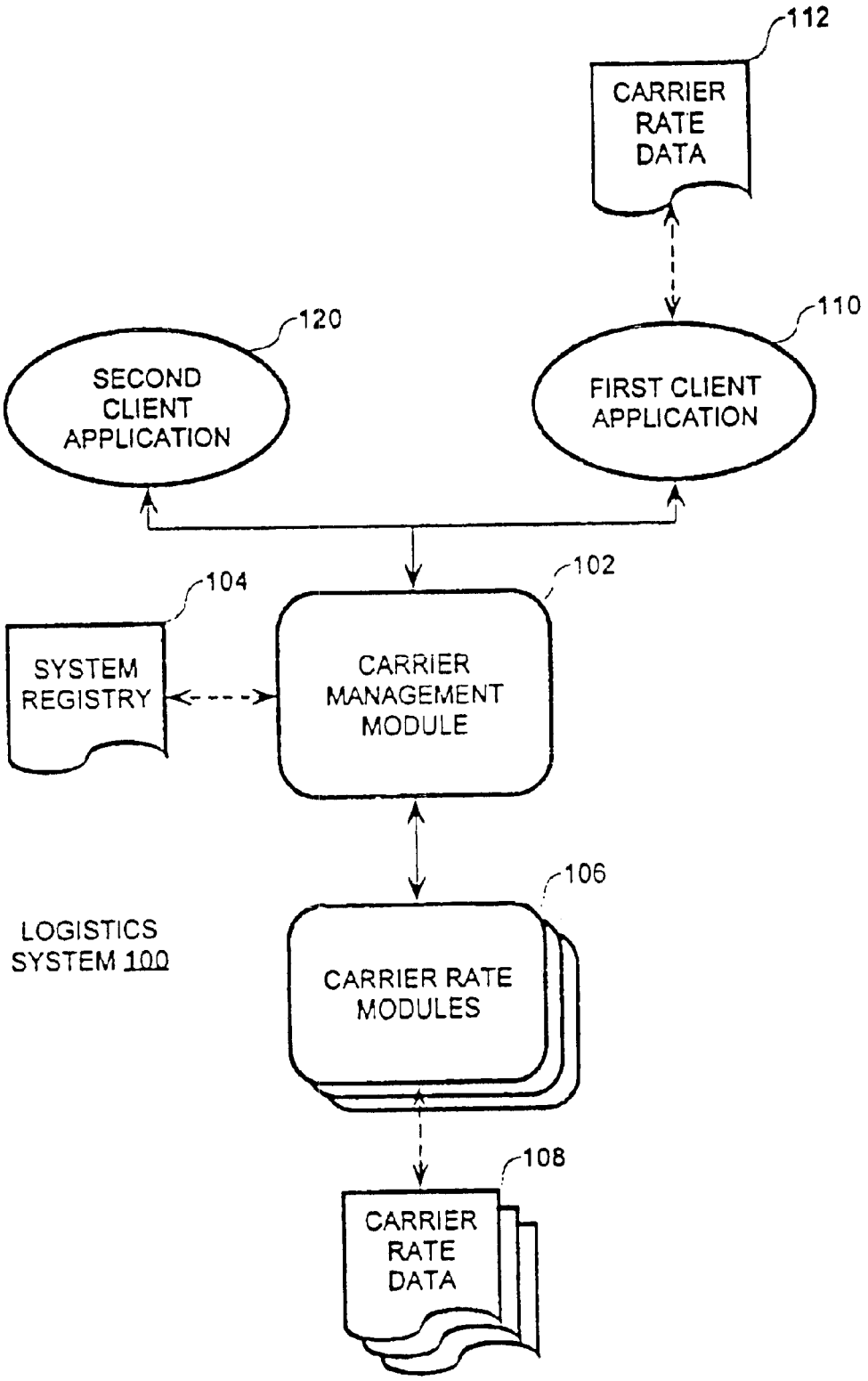
FIG. 1 is a block diagram of a logistics system described in a related application.
Figure 2:
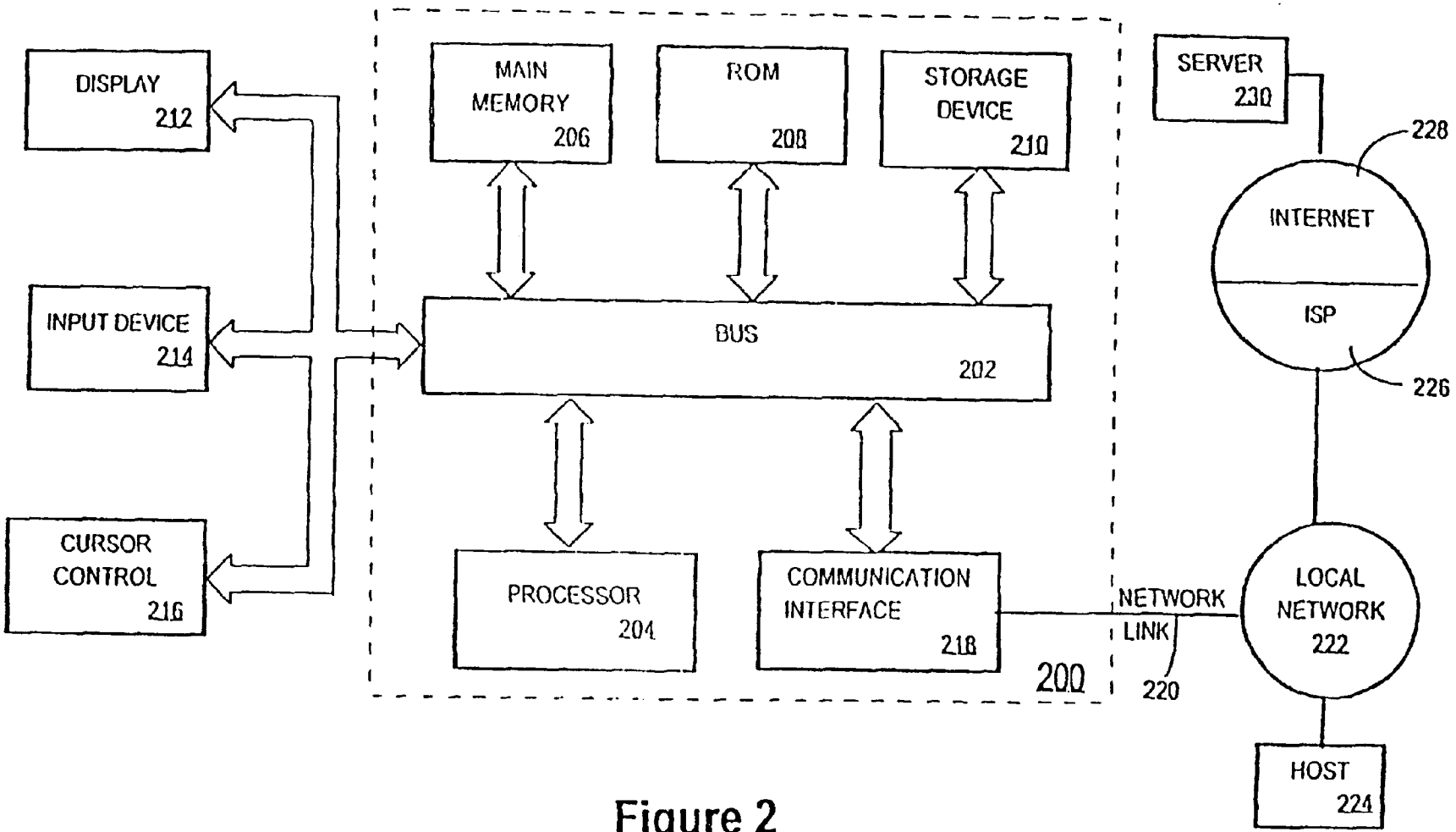
FIG. 2 is a block diagram of computer system that can be used to implemented the present invention.

FIG. 2 is a block diagram that illustrates a computer system 200 upon which an embodiment of the invention may be implemented. Computer system 200 includes a bus 202 or other communication mechanism for communicating information, and a processor 204 coupled with bus 202 for processing information. Computer system 200 also includes a main memory 206, such as a random access memory (RAM) or other dynamic storage device, coupled to bus 202 for storing information and instructions to be executed by processor 204. Main memory 206 also may be used for storing temporary variables or other intermediate information during execution of instructions to be executed by processor 204. Computer system 200 further includes a read only memory (ROM) 208 or other static storage device coupled to bus 202 for storing static information and instructions for processor 204. A storage device 210, such as a magnetic disk or optical disk, is provided and coupled to bus 202 for storing information and instructions. Common examples of computer system 200 include personal computers, workstations, minicomputers, servers, and mainframes.

Computer system 200 may be coupled via bus 202 to a display 212, such as a cathode ray tube (CRT), for displaying information to a computer user. An input device 214, including alphanumeric and other keys, is coupled to bus 202 for communicating information and command selections to processor 204. Another type of user input device is cursor control 216, such as a mouse, a trackball, or cursor direction keys for communicating direction information and command selections to processor 204 and for controlling cursor movement on display 212. This input device typically has two degrees of freedom in two axes, a first axis (e.g., x) and a second axis (e.g., y), that allows the device to specify positions in a plane.

The invention is related to the use of computer system 200 for rating items for carriers. According to one embodiment of the invention, rating items for carriers is provided by computer system 200 in response to processor 204 executing one or more sequences of one or more instructions contained in main memory 206. Such instructions may be read into main memory 206 from another computer-readable medium, such as storage device 210. Execution of the sequences of instructions contained in main memory 206 causes processor 204 to perform the process steps described herein. One or more processors in a multi-processing arrangement may also be employed to execute the sequences of instructions contained in main memory 206. In alternative embodiments, hard-wired circuitry may be used in place of or in combination with software instructions to implement the invention. Thus, embodiments of the invention are not limited to any specific combination of hardware circuitry and software.

The computer system 200 may be operated by a user, for example, sitting at a desk with a keyboard as an input device 214, a mouse as a cursor device 216, and a monitor as a display device 212. The user types commands through the keyboard or clicks on icons displayed on the monitor with the mouse to execute instructions that rate a package or other item. The results of rating the item may be displayed to the user on the monitor or saved to a file in storage device 210 for use by other programs, e.g. an application to print a bill of lading through a printer or apply postage through a specialized peripheral device coupled to bus 202.

The term "computer-readable medium" as used herein refers to any medium that participates in providing instructions to processor 204 for execution. Such a medium may take many forms, including but not limited to, non-volatile media, volatile media, and transmission media. Non-volatile media include, for example, optical or magnetic disks, such as storage device 210. Volatile media include dynamic memory, such as main memory 206. Transmission media include coaxial cables, copper wire and fiber optics, including the wires that comprise bus 202. Transmission media can also take the form of acoustic or light waves, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a computer can read.

Various forms of computer readable media may be involved in carrying one or more sequences of one or more instructions to processor 204 for execution. For example, the instructions may initially be borne on a magnetic disk of a remote computer. The remote computer can load the instructions into its dynamic memory and send the instructions over a telephone line using a modem. A modem local to computer system 200 can receive the data on the telephone line and use an infrared transmitter to convert the data to an infrared signal. An infrared detector coupled to bus 202 can receive the data carried in the infrared signal and place the data on bus 202. Bus 202 carries the data to main memory 206, from which processor 204 retrieves and executes the instructions. The instructions received by main memory 206 may optionally be stored on storage device 210 either before or after execution by processor 204.

Computer system 200 also includes a communication interface 218 coupled to bus 202. Communication interface 218 provides a two-way data communication coupling to a network link 220 that is connected to a local network 222. For example, communication interface 218 may be an integrated services digital network (ISDN) card or a modem to provide a data communication connection to a corresponding type of telephone line. As another example, communication interface 218 may be a local area network (LAN) card to provide a data communication connection to a compatible LAN. Wireless links may also be implemented. In any such implementation, communication interface 218 sends and receives electrical, electromagnetic or optical signals that carry digital data streams representing various types of information.

Network link 220 typically provides data communication through one or ore networks to other data devices. For example, network link 220 may provide a connection through local network 222 to a host computer 224 or to data equipment operated by an Internet Service Provider (ISP) 226. ISP 226 in turn provides data communication services through the world wide packet data communication network, now commonly referred to as the "Internet" 228. Local network 222 and Internet 228 both use electrical, electromagnetic or optical signals that carry digital data streams. The signals through the various networks and the signals on network link 220 and through communication interface 218, which carry the digital data to and from computer system 200, are exemplary forms of carrier waves transporting the information.

Computer system 200 can send messages and receive data, including program code, through the network(s), network link 220 and communication interface 218. In the Internet example, a server 230 might transmit a requested code for an application program through Internet 228, ISP 226, local network 222 and communication interface 218. In accordance with the invention, one such downloaded application provides for rating items for carriers as described herein.

The received code may be executed by processor 204 as it is received, and/or stored in storage device 210, or other non-volatile storage for later execution. In this manner, computer system 200 may obtain application code in the form of a carrier wave.

System Overview

Figure 3:
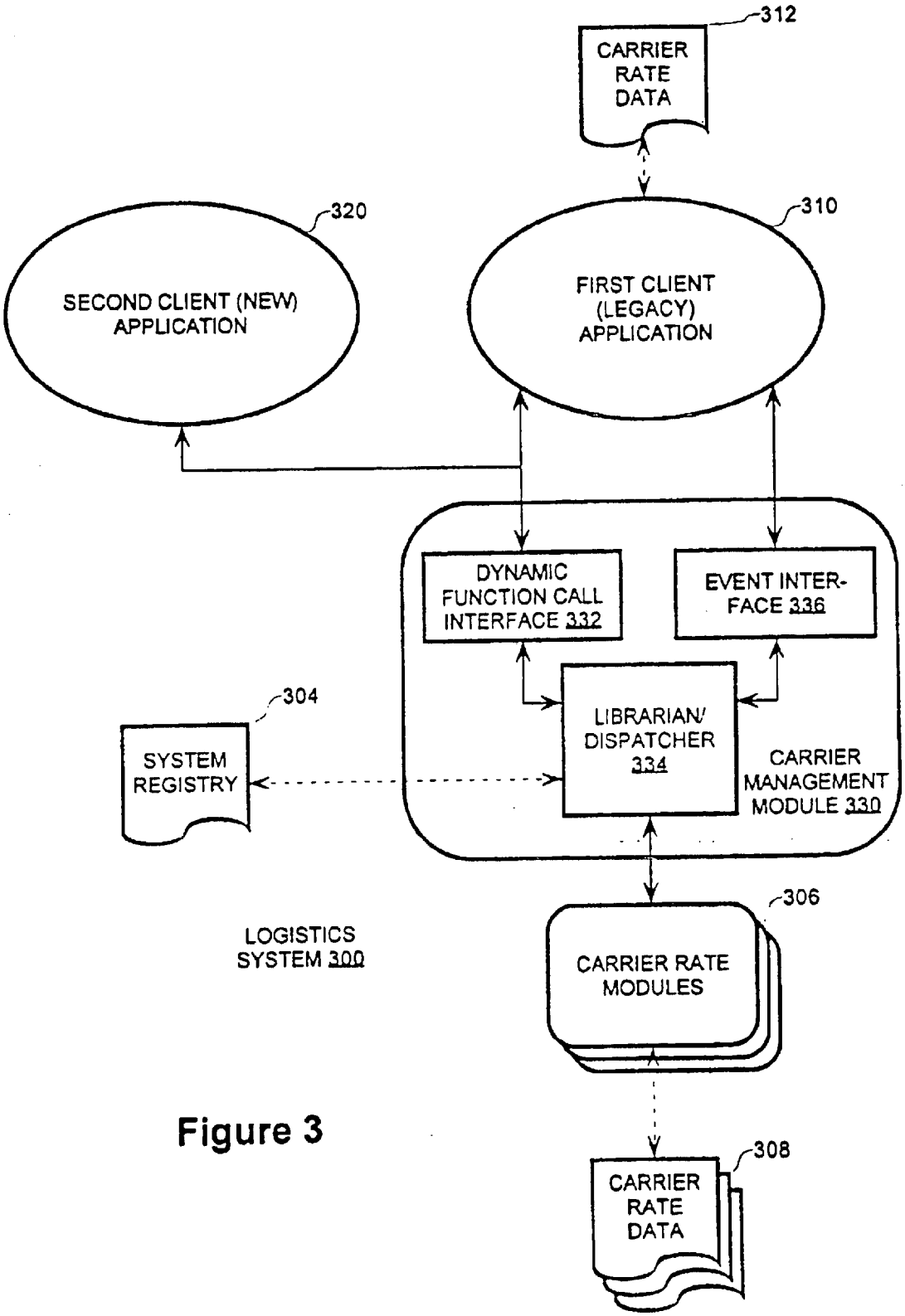
FIG. 3 is a block diagram of a logistics system according to one embodiment of the present invention.

Referring to FIG. 3, depicted is a diagram of a logistics system 300, which can be implemented on a computer system. In a preferred embodiment, logistics system 300 is implemented on a personal computer or workstation running a windowing operation system such as Microsoft WINDOWS™ 3.1, WINDOWS 95™, or WINDOWS NT™. However, it is evident to those skilled in the art that other operating systems, such as IBM's OS/2™ T and the UNIX™ operating system running an X-Windows server, can be used to implement the present invention.

In the logistics system 300 is a plurality of client applications, of which two client applications 310 and 320 are depicted in FIG. 3. Each client application is an executable program, which can be initiated by a user through keyboard commands, by double-clicking an icon, and the like. Client applications provide an interface for interacting with the user, and each implements high-level logistics functionality. For example, a client application may be a shipping application, responsible for grouping letters, packages, parcels, bulk goods, commodities, or any other transportable item into shipments to be shipped by a carrier. Some client applications may implement or utilize functions for handling shipping manifests, printing labels, controlling inventory, load balancing, applying postage, and the like. For purposes of illustration, the first client application 310 is a legacy shipping application or any other application having internal carrier rating routines, e.g. by accessing carrier data 312. The second client application 320 may be a new load planning application, already configured to use carrier management module 330 for its item rating needs, but for which it is desired to supply the rating functionality of the legacy application.

In the system architecture illustrated in FIG. 3, at least some of the item rating functionality is coordinated through carrier management module 330. This functionality is implemented directly by carrier rate modules 306. In typical implementations, the carrier management module 330 and carrier rate modules 306 are run-time loadable or dynamically linkable libraries. Dynamic linking a module involves loading at run-time the module into the executable space of an executing process, e.g. a portion of virtual memory allocated by the operating system for executing a process such as client application 310. Common examples of these modules include dynamic link library (DLL) modules, shared libraries, and OLE™ and ACTIVEX™ controls supported by Microsoft Corp.

Carrier management module 330 contains instructions for managing rating operations with regard to services of a plurality of supported carriers. The carrier management module 330 is dynamically linked into a client application. By loading the carrier management module 330 directly into the executable space of an executing process, the client application can avail itself of functionality implemented in the module without the overhead incurred for a separate process. Thus, entries in a process table of the operating system are saved and costly context swaps are avoided.

The carrier management module 330 provides a dynamic function call interface 332 for receiving commands from both first client application 310 and second client application 320. A function call interface is one of the most basic and direct mechanisms for calling a software routine. In calling a function, a program counter, which is contained in a register of the computer system pointing to the proper instruction to execute, is saved in a stack and then set to the entry point of the software routine. Upon completion of the routine, the saved program counter is read from the stack, causing control to return to the calling software module. Typically, this function call interface 332 is a late-binding interface, in which the entry point of a software routine is not determined until run-time, generally by looking up a string indicating the routine's name in a table.

A re-entrant version of carrier management module 330 may even be linked and loaded into one executing client application such as, for example, first client application 310 and set up to be concurrently invoked by another separately executing process such as, for example, second client application 320, through a late-binding, dynamic function call interface 332. In order for the second process to concurrently invoke a loaded, carrier management module 330, the second process "binds" to the loaded carrier management module 330, which set up the data segments to point within the data space of the loaded module. OLE and ACTIVEX controls, sometimes called "OCX," allow for the creation of re-entrant modules with late binding of function calls, remote execution in a distributed or networked environment, and interfacing with the Internet or World Wide Web.

Some of the rating functionality for first client application 310 is performed by carrier rate modules 306, through late-binding function call interface 332. On the other hand, the internal carrier rating routines of first client application 310, which access carrier data 312 directly, may use a static function call interface using early binding. The entry points for the static function calls are determined at the time the program was built, not executed, hence "early" binding.

Carrier management module 330 includes a librarian/dispatcher 334 configured to read a system registry 304 of supported carriers and provide entry points for item rating instructions of carrier rate modules 306 corresponding to selected carriers. The commands received through the function call interface 332 are passed to the librarian/dispatcher 334 for handling.

Carrier management module 330 also includes an event interface 336 for sending events to first client application 310. As well known in the art, windowing operating systems such as Microsoft WINDOWS™ place "events," which are numerical values representing logical or physical events in the computer system into a queue assigned to each running application. For example, one physical event is that the user moved the mouse. In this case, the numerical value would include a code that indicates that the mouse moved and integers representing the location to which the mouse cursor has moved. A logical event often indicates a request for the application to perform an action, such as repainting a window or terminating execution. Each application has event loop in which events are successively removed from event queue, inspected, and processed. Operating systems typically allow application developers to define a number of "user-defined" events to custom the behavior of their applications. In the example, a mouse movement event would result in the mouse cursor being erased at the old location and repainted at the new location.

Consequently, the event interface 336 allows the carrier management module 330 to dispatch user-defined events to the first client application 310. As the first client application 310 monitors its own event queue in its event loop, it will dequeue this user-defined event, and in response, execute the instructions that access and use the carrier data if available. In specific, the user-defined event in question requests the first client application 310 to access its own carrier rating routines. In general, it is not difficult to add support for such a user-defined event in a legacy, WINDOWS application, because, WINDOWS applications have always used event loops, from the beginning of Windows up to the present.

To facilitate the placement of new events in the event queue of first client application 310, it is preferable for the first client application to load the carrier management module 330 and have the second client application 320 bind to the loaded, carrier management module 330. If the carrier management module 330 is loaded by the first client application 310, then the carrier management module 330 has access to objects in the data space of the first client, which make it easier to place a new event in the event loop of the first client application 310.

One approach to determine whether the carrier management module 330 is already loaded is to consult a running object table. A running object table indicates which modules have been loaded, or, if the module is object-based like Microsoft OLE™, which objects have been loaded. It should be evident to those skilled in the art that operating systems other than Microsoft WINDOWS may provide other techniques for determining whether a module is loaded or a process is executing. For example, in the UNIX™ operating system, one can execute a "ps" command. If the carrier management module 330 is already loaded, then the second application will bind to the carrier management module 330. Binding to a running module allows one to call routines loaded into the executable space in another process and entails setting certain operating pointers such as data segments to point to the data space of the other process.

Many operating systems, such as WINDOWS 95™ and WINDOWS NT™, available from Microsoft Corp., provide a resource called a system registry to contain operational information for software systems. In accordance with one embodiment of the present invention, carrier information and settings are stored in the system registry. The present invention is not limited to storing information in a specially provided system registry. Indeed, any file can be used as registry if it contains a list of carriers identified by a name or token and identifiers of corresponding carrier rate modules 240 in a one-to-one association. For example, such a registry may be implemented on UNIX™ systems or MS-DOS™ by a configuration file.

In particular, the system registry 304 contains carrier identifiers and module identifiers in a one-to-one association. The carrier identifier is preferably a token or short string (within eight characters) denoting a carrier. Common token values can include "USPS" for the United States Postal Service, "YELL" for the Yellow Freight System, Inc., "UPS" for the United Parcel Service, etc. The module identifier identifies how to load a carrier rate module 306, which contains instructions for rating an item according to business rules and rate data for a carrier. The value of the module identifier depends on how the carrier rate modules 306 are implemented. If the carrier rate modules 304 are implemented as DLLs or other run-time loadable libraries, then the identifier contains the full pathname of the library. On the other hand, if the carrier rate modules 306 are implemented as OLE or ACTIVEX controls, then the module identifier can be a class identifier, such as a guid (globally unique identifier), 128-bit hexadecimal value.

Included in the logistics system 300 is a plurality of carrier rate modules 306. Although three carrier rate modules 306 are shown, it is evident that any number of carrier rate modules 306 may be installed on a logistics system 300 and that the particular number installed depends on the customer environment. Only the carrier rate modules 306 for those carriers desired by a user need be installed. For example, at a site in which only packages are sent, the carrier rate modules 306 for LTL rating do not have to be installed. Each carrier rate module 306 is configured to be loaded at run-time into the executable space of an executing process, e.g. first client application 310. Accordingly, the carrier rate modules 306 are preferably implemented with such techniques ashy shared libraries, or by other kinds of dynamic linking, such as OLE and ACTIVEX controls.

In the architecture depicted in FIG. 3, the dynamic, the function call interface 332 allows both the first client application 310 and the second client application 320 to initiate commands with the carrier management module 330. The event interface 336 allows the carrier management module 330 to initiate commands to the first client application 310. The new application can call the carrier management module 320 through the dynamic, function call interface 332. In response, the carrier management module 320 can relay the request of the new application to the legacy application through the event interface 336. Thus, the disclosed architecture provides a mechanism, the event interface 336, for a new application (second client application 320) to request a legacy application (first client application 310) to perform a task without necessitating a large-scale modification to made to the legacy application.

Rating Items at the First Client Application

Figure 4:
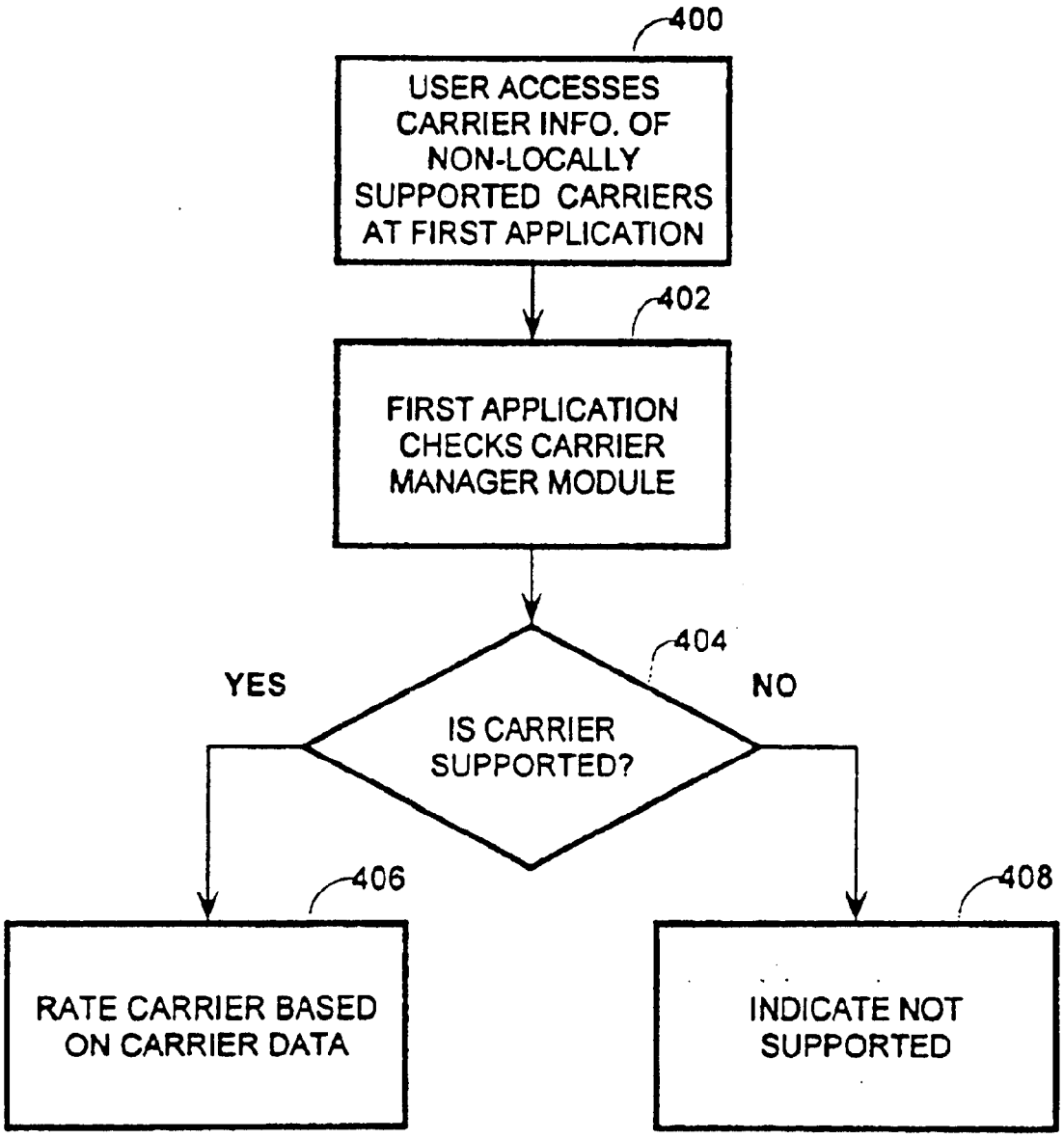
FIG. 4 is a flowchart illustrating the operation of one embodiment of the present invention, when initiated by a user through a first application.

Referring to FIG. 4, a flowchart illustrates the steps of operating one embodiment of the present invention for a user at the first client application 310, for example a legacy shipping application. In step 400, the user at the first client application 310 attempts to access carrier information for carriers not directly supported by the first client application 310, e.g. a trucking carrier. Rating carriers with carrier rate data 312, in the example express carriers, occurs directly without the use of carrier management module 330.

In response to the attempt to access information for non-directly supported carriers, instructions in the first client application 310 call the carrier management module 330 through a first interface, viz. the dynamic function call interface 332, in step 402. Since carrier management module 330 has been linked and loaded into the first client application 310, the first client application 334 can call routines in the carrier management module 330 via a function call. The function call may occur directly or through indirection, i.e. through a pointer to a function storing an entry point for a routine in the carrier management module 330. Generally, the routines called through the function call interface 332 are routines in the librarian/dispatcher 334 portion of the carrier management module 330. For example, a first client application 310 may call a routine in the carrier management module 330 to return an entry point for an item rating routine in a selected carrier rate module 306. Since the carrier rate module 306 is also dynamically linked and loaded, the first client application 310 can call the item rating routine directly through the standard function call interface.

The librarian/dispatcher 334 of the carrier management module 330 includes routines for determining whether the carrier is supported by a carrier rate module 306 (step 404). For example, the librarian/dispatcher 334 may be configured to read system registry 304 for an entry corresponding to the requested carrier, determined by a carrier identifier. The corresponding entry contains the carrier identifier and a module identifier indicating how to load the corresponding carrier rate module 306. Preferably, the relevant entries of the system registry 304 are read during an initialization routine in the librarian/dispatcher 334 called by first client application 310 at start-up and cached in the local memory of the carrier management module 330. The actual loading of the carrier rate modules 306 may occur during this initialization phase or on demand.

If the carrier is supported by a carrier rate module 306, then the carrier information can be used, for example, to rate items for the carrier based on associated carrier rate data 308 (step 406). This may occur by executing an item rating routine in the appropriate carrier rate module 306, called by first client application 310 or the carrier management module 330. If, on the other hand, the carrier is not supported, then the carrier management module 330 indicates that it is not supported to the first client application 310 (step 408). This information is passed back through a standard function call return mechanism in the function call interface 332.

Rating Items at the Second Client Application

Figure 5:
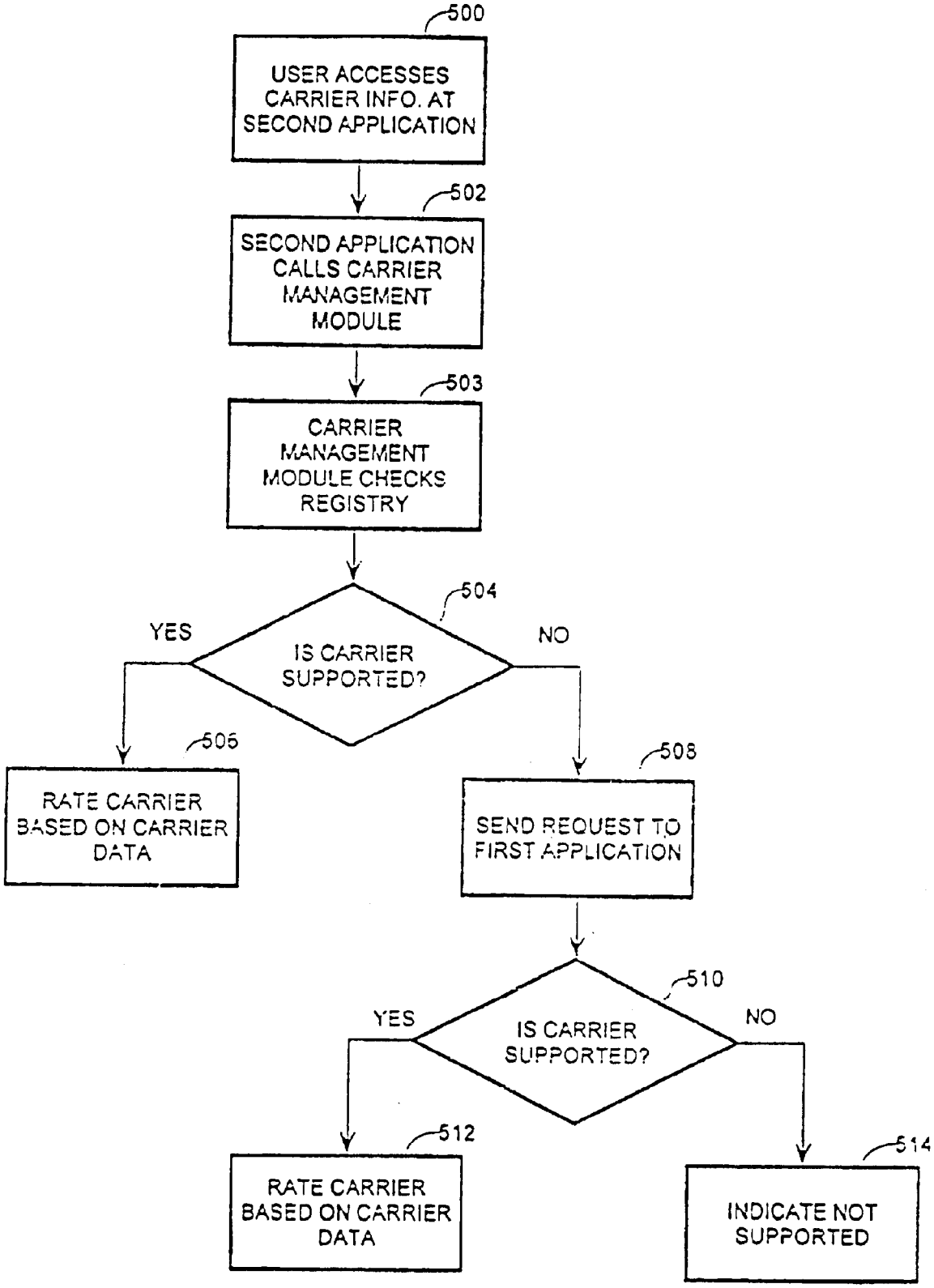
FIG. 5 is a flowchart illustrating the operation of one embodiment of the present invention, when initiated by a user through a second application.

Referring to FIG. 5, a flowchart illustrates the steps of operating one embodiment of the present invention for a user at the second client application 320. In step 500, the user attempts to access carrier information at the second client application 320. For example, the second client application 320 may be a load planning application, for which it is useful to know how much a package would by rated by an express carrier. In this example, none of the carrier rate modules 306 support this express carrier, but the first client application 310 (e.g. a legacy shipping application) does support the express carrier.

In response to the user request, the second client application calls a routine (step 502) in the carrier management module 330 through dynamic, function call interface 332 to access the carrier information, such as the carrier rate data 308. As mentioned hereinabove, the second client application preferably binds to an already loaded carrier management module 332 by consulting a running object table.

In step 503, the librarian/dispatcher 334 of the carrier management module 330 checks information read from the system registry 304 (step 503) to determine whether the carrier is supported by a carrier rate module 306. Preferably, the library/dispatcher checks information cached from reading the system registry at initialization time. If there is a carrier identifier in the system registry (step 504), then the carrier is supported. If the carrier is supported, then the carrier information can be used, for example, to enable rating of items for the carrier based on associated carrier rate data 308 (step 506). This may occur by the carrier management module 330 passing by a function pointer of an entry point in the carrier rate module 306 for the second client application 320 to execute. Alternatively, the carrier management module 330 can call the rating routine in the carrier rate module 306 directly. In this example, since none of the carrier rate modules 306 supports the express carrier, the result of step 504 indicates the carrier is not supported by the carrier rate modules 306.

If, on the other hand, the carrier is not supported by a carrier rate module 306, as in this example, then the librarian/dispatcher 334 redirects the user request to first client application 310 by dispatching the request through event interface 336 (step 508). Specifically, the librarian/dispatcher 334 enqueues a user-defined event in the event queue of the first client application 310. This user-defined event instructs the first client application 310 to access the carrier information of the requested carrier, for example to rate an item for the requested carrier. The first client application 310 in its event loop will eventually dequeue the user-defined event and execute a local routine to determine whether the requested carrier is directly supported by the first client application 310 (step 510).

If the carrier is not supported, then the first client application 310 will signal back to the carrier management module 330 that fact, which the carrier management module 330 passes back to the second client application 320 (step 514). On the other hand, if the carrier is supported, as in this example, then the first application executes its own routines directly for accessing the carrier information stored in carrier rate data 312. The results of accessing the carrier information at the first client application 310 are signaled back to the carrier management module 330 and passed back to the second client application 320 (step 512).

By providing an event interface 336 in the carrier management module 330 to send events to the first client application 310, a second client application 320 can access the carrier functionality implemented by the first client application 310. This approach greatly reduces implementation costs, because the carrier management module 330 already exists for use with the carriers supported by the carrier rate modules 306. Moreover, the carrier manger 330 brokers the requests from the second client application 320 to the first client application 320 via one of the oldest mechanisms, the event loop, in the windowing operating system. Thus, the infrastructure to handle events in general is already present, even in legacy system, reducing the scale of changes needed to impart the carrier rating functionality of the first client application 310 to the second client application 320.

While this invention has been described in connection with what is presently considered to be the most practical and preferred embodiment, it is to be understood that the invention is not limited to the disclosed embodiment, but on the contrary, is intended to cover various modifications and equivalent arrangements included within the spirit and scope of the appended claims.

What is claimed is:

1. A carrier management system, comprising:

(a) a first application configured to rate items for a first carrier; and (b) a carrier management module configured to load one or more carrier rate modules for rating items for one or more supported carriers;

(c) a second application configured to send a request to the carrier management module for rating an item for a selected carrier; wherein the carrier management module is configured, in response to the second application, to:

(i) determine whether the selected carrier is supported by one of the carrier rate modules;

(ii) if the selected carrier is supported by one of the carrier rate modules, then enable rating of the item for the selected carrier by the one carrier rate module; and (iii) if the selected carrier is not supported by one of the carrier rate modules, then cause the first application to rate the item for the selected carrier.

2. The carrier management system of claim 1, wherein the first application is further configured to load the carrier management module into the executable space of the first application.

3. The carrier management system of claim 2, wherein the second application is further configured to bind to a loaded instance of the carrier management module.

4. The carrier management system of claim 1, wherein the carrier management module further is configured to dispatch an event to the first application for rating the selected item.

5. The carrier management system of claim 1, wherein the carrier management module is further configured to:

(a) access a registry recording carrier identifiers indicative of carriers and associated module identifiers indicative of loading carrier rate modules;

(b) load the carrier rate module based on the accessed module identifier indicative of loading the carrier rate module;

(c) determine whether there exists a carrier identifier recorded in the registry indicative of a carrier specified by the second application; and (d) if there does not exists a carrier identifier recorded in the registry indicative of the specified carrier, then
(i) dispatch an event to the first application for rating the selected item to produce a rating result and
(ii) return the rating result to the second application.

6. A method of coordinating a request to rate an item for a carrier supported by a first application, comprising the computer-implemented steps of:

(a) receiving the request through a first interface as a function call from a second application;

(b) dispatching the request through a second interface as an event to the first application;

(c) receiving a rating result from the first application; and (d) returning the rating result to the second application.

7. The method of claim 6, wherein the step of receiving the request through a first interface as a function from a second application includes the step receiving the request through a dynamic, function call interface from the second application.

8. The method of claim 6, wherein the step of dispatching the request through a second interface to the first application includes the step of enqueuing an event indicative of the request in an event queue of the first application.

9. The method of claim 6, further comprising the computer-implemented steps of:

(a) loading a carrier management module into the executable space of a first application; and (b) determining, in said second application, whether a carrier management module is loaded by another application and, if loaded, binding to the loaded carrier management module.

10. The method of claim 9, wherein the step of determining whether a carrier manager module is loaded by another application includes the steps of:

(a) accessing a running object table recording which modules have been loaded; and (b) determining whether information about the carrier management module is recorded in the running object table.

11. A method of coordinating a request to rate an item for a carrier, comprising the computer-implemented steps of:

(a) loading a plurality of carrier rate modules into the executable space of an application;

(b) receiving the request to rate the item for the carrier;

(c) determining whether one of the a carrier rate modules is configured to rate the item for the carrier;

(d) if there is a carrier rate module configured to rate the item for the carrier, then enabling rating of the item by the carrier rate module; and (e) if there is not a carrier rate module configured to rate the item for the carrier, then
(i) dispatching an event indicative of the request to the application, and
(ii) receiving a rating result indicative of rating the item for the carrier from the application.

12. The method of claim 11, wherein the step (c) includes the steps of:

(a) accessing a registry recording carrier identifiers indicative of carriers and associated module identifiers indicative of loading carrier rate modules; and (b) determining whether the carrier is recorded in the registry.

13. A computer-readable medium bearing a carrier management module including sequences of instructions, which when executed by a computer system, cause the computer system to perform the steps of:

(a) receiving the request through a first interface as a function call from a second application;

(b) dispatching the request through a second interface as an event to (the first application;

(c) receiving a rating result from the first application; and (d) returning the rating result to the second application.

14. The computer-readable medium of claim 13, wherein the step of receiving the request through a first interface as a function call from a second application includes the step receiving the request through a dynamic, function call interface from the second application.

15. The computer-readable medium of claim 13, wherein the step dispatching the request through a second interface to the first application includes the step of enqueuing an event indicative of the request in an event queue of the first application.

16. A computer-readable medium bearing a carrier management module including sequences of instructions, which when executed by a computer system, cause the computer system to perform the steps of:

(a) loading a plurality of carrier rate modules into the executable space of an application;

(b) receiving the request to rate the item for the carrier;

(c) determining whether one of the a carrier rate modules is configured to rate the item for the carrier;

(d) if there is a carrier rate module configured to rate the item for the carrier, then enabling rating of the item by the carrier rate module; and (e) if there is not a carrier rate module configured to rate the item for the carrier, then
(i) dispatching an event indicative of the request to the application; and
(ii) receiving a rating result indicative of rating the item for the carrier from the application.

17. The computer-readable medium of claim 16, wherein the step (c) includes the steps of:

(a) accessing a registry recording carrier identifiers indicative of carriers and associated module identifiers indicative of loading carrier rate modules; and (b) determining whether the carrier is recorded in the registry.

* * * * *